US006902254B2

(12) United States Patent
Sugaya et al.

(10) Patent No.: US 6,902,254 B2
(45) Date of Patent: Jun. 7, 2005

(54) PRINTER SYSTEM WHICH USES A PLURALITY OF PRINT HEADS AND WHICH CONTROLS THE PRINT HEADS WITH A SIMPLE CONFIGURATION TO ACHIEVE HIGH ACCURACY IMAGE PRINTING

(75) Inventors: Takumi Sugaya, Tokyo (JP); Toshihiro Kitahara, Tachikawa (JP); Hiroshi Hashi, Tokyo (JP); Fujio Kosaka, Hino (JP); Katsunori Kumai, Hino (JP)

(73) Assignee: Olympus Optical Co., Ltd., Tokyo (JP)

( * ) Notice: Subject to any disclaimer, the term of this patent is extended or adjusted under 35 U.S.C. 154(b) by 81 days.

(21) Appl. No.: 10/213,519

(22) Filed: Aug. 7, 2002

(65) Prior Publication Data

US 2003/0044211 A1 Mar. 6, 2003

(30) Foreign Application Priority Data

Aug. 9, 2001 (JP) ..... 2001-242730

(51) Int. Cl.[7] ..... B41J 2/14; B41J 29/38

(52) U.S. Cl. ..... 347/50; 347/12

(58) Field of Search ..... 347/5, 9, 12, 14, 347/19, 50, 54, 56, 68, 40–43

(56) References Cited

U.S. PATENT DOCUMENTS 5,748,207 A * 5/1998 Inui et al. ..... 347/43
5,847,724 A * 12/1998 Mantell ..... 347/15
6,048,045 A * 4/2000 Nohata et al. ..... 347/7
6,267,467 B1 * 7/2001 Otsuki ..... 347/43
6,477,589 B1 * 11/2002 Suzuki et al. ..... 710/18
6,499,069 B1 * 12/2002 Shimura ..... 710/62

* cited by examiner

*Primary Examiner*—Stephen D. Meier
*Assistant Examiner*—An H. Do
(74) *Attorney, Agent, or Firm*—Frishauf, Holtz, Goodman & Chick, P.C.

(57) ABSTRACT

A printer system includes a host computer, K, C, M, and Y printer elements for four colors, a paper feeding section, and a head cleaning section. The printer elements each include a head controller and print head groups. The head controllers are connected to the host computer via SCSI interfaces in a daisy chain. When printing, the host computer transfers information, such as an image-printing region, image-printing data, to the head controllers via the SCSI interfaces, thereby executing image printing. The printer system can control a large number of print heads with a simple configuration and also can perform high-accuracy image printing.

6 Claims, 10 Drawing Sheets

PRINTER SYSTEM WHICH USES A PLURALITY OF PRINT HEADS AND WHICH CONTROLS THE PRINT HEADS WITH A SIMPLE CONFIGURATION TO ACHIEVE HIGH ACCURACY IMAGE PRINTING

This application claims the benefit of Japanese Application No. 2001-242730 filed in Japan on Aug. 9, 2001, the entire contents of which are incorporated herein by reference.

BACKGROUND OF THE INVENTION

1. Field of the Invention

The present invention relates to a printer system that performs image printing using a plurality of print heads having a plurality of nozzles for discharging ink droplets.

2. Related Art Statement

Conventionally, as a color inkjet printer that uses a plurality of print heads, each print head being assigned one color and having a plurality of nozzles for discharging ink droplets, a head-scan color inkjet printer that performs color printing by causing the plurality of print heads to scan in a direction perpendicular to the paper feeding direction has been available.

Meanwhile, in recent years, what is called a head-non-scan one-pass inkjet printer has been proposed. In this printer, print head groups are configured such that a plurality of print heads having rows of nozzles is arranged in the paper width direction. The print head groups are provided so as to correspond to the number of colors to be used, each print head group being assigned one color. With this arrangement, the printer performs high-speed printing by feeding only paper in one direction without causing the head to scan.

However, in general, inkjet printers become more difficult to manufacture and more expensive as the number of rows of nozzles increases. Thus, a width that can be printed by a single head used in the head-non-scan one-pass inkjet printer is not much different from a width that can be printed with one scan by a head used in the head-scan inkjet printer. As a result, with the head-non-scan one-pass inkjet printer, when the paper width is increased from A4 size to A3 size (JIS standard) . . . , or the number of ink colors is increased, the number of print heads used is significantly increased.

Since the head controllers for the discharge of ink from the print heads in the conventional scan-type inkjet printer only control, for example, four print heads for four colors, they do not have a particularly complicated structure. However, with the non-scan inkjet printer, which uses the plurality of print head groups constituted by the plurality of print heads, the positions of data corresponding to the rows of nozzles which are read from a buffer memory need to be changed so as to correspond to the intervals of the rows of nozzles in a large number of heads. In addition, since the number of print heads is greater than that number of printer heads in the scan-type inkjet printer, the capacity of the buffer memory is increased correspondingly.

As a result, there is a need for changing the pointer in the memory for each of the large number of the rows of nozzles (for each print head) by using a large-capacity buffer. Thus, when a single head controller needs to be used for the large number of print heads, there is a problem in that the control becomes significantly complicated.

In particular, with the non-scan inkjet printer that uses the large number of print head groups, since the print head groups for individual colors are arranged with a certain distance therebetween with respect to the paper feeding direction, there is a possibility that image-printing positions are displaced between print head groups due to an error in a scale pitch, which is a reference for the discharge timing. Thus, the image-printing accuracy may be adversely affected.

SUMMARY OF THE INVENTION

The present invention has been made to overcome the above problems, and an object of the present invention is to provide a printer system that uses a plurality of print head groups, allows the control of the print heads with a simple configuration, and performs image printing with high accuracy.

The printer system of the present invention is a printer system that performs printing on a recording medium. The printer system includes a plurality of printer elements. Each printer element includes a one-color print-head group constituted by a plurality of print heads for a single color, a head controller for controlling the one-color print-head group, and a host interface circuit for controlling the one-color print-head group. The plurality of printer elements is controlled by a single host computer.

The other features and advantages of the present invention will become apparent from the following description.

DETAIL DESCRIPTION OF THE PREFERRED EMBODIMENTS

Embodiments of the present invention will be described below with reference to the accompanying drawings.

Figure 1:
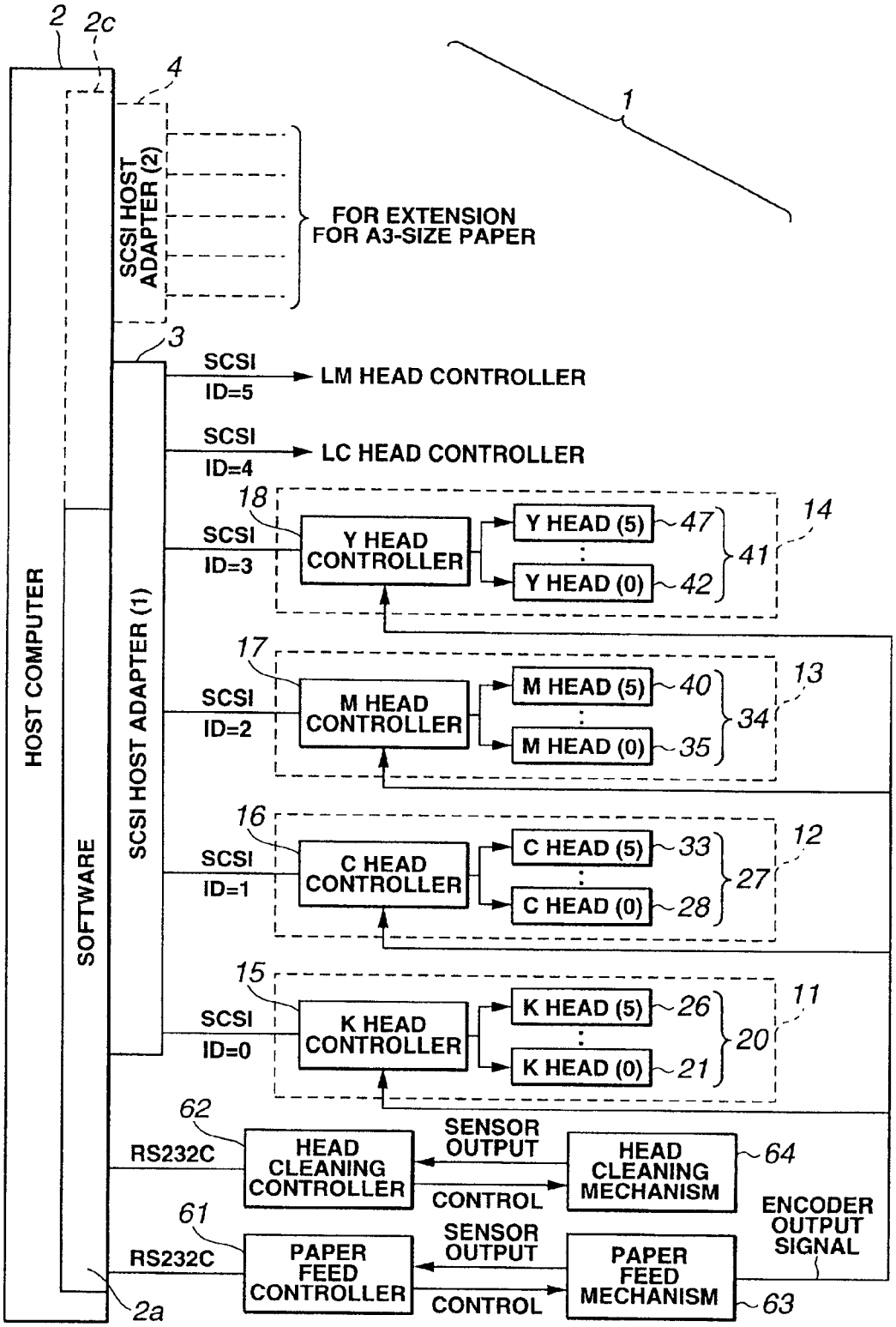
FIG. 1 is a block diagram of printer system according to a first embodiment of the present invention.
Figure 2:
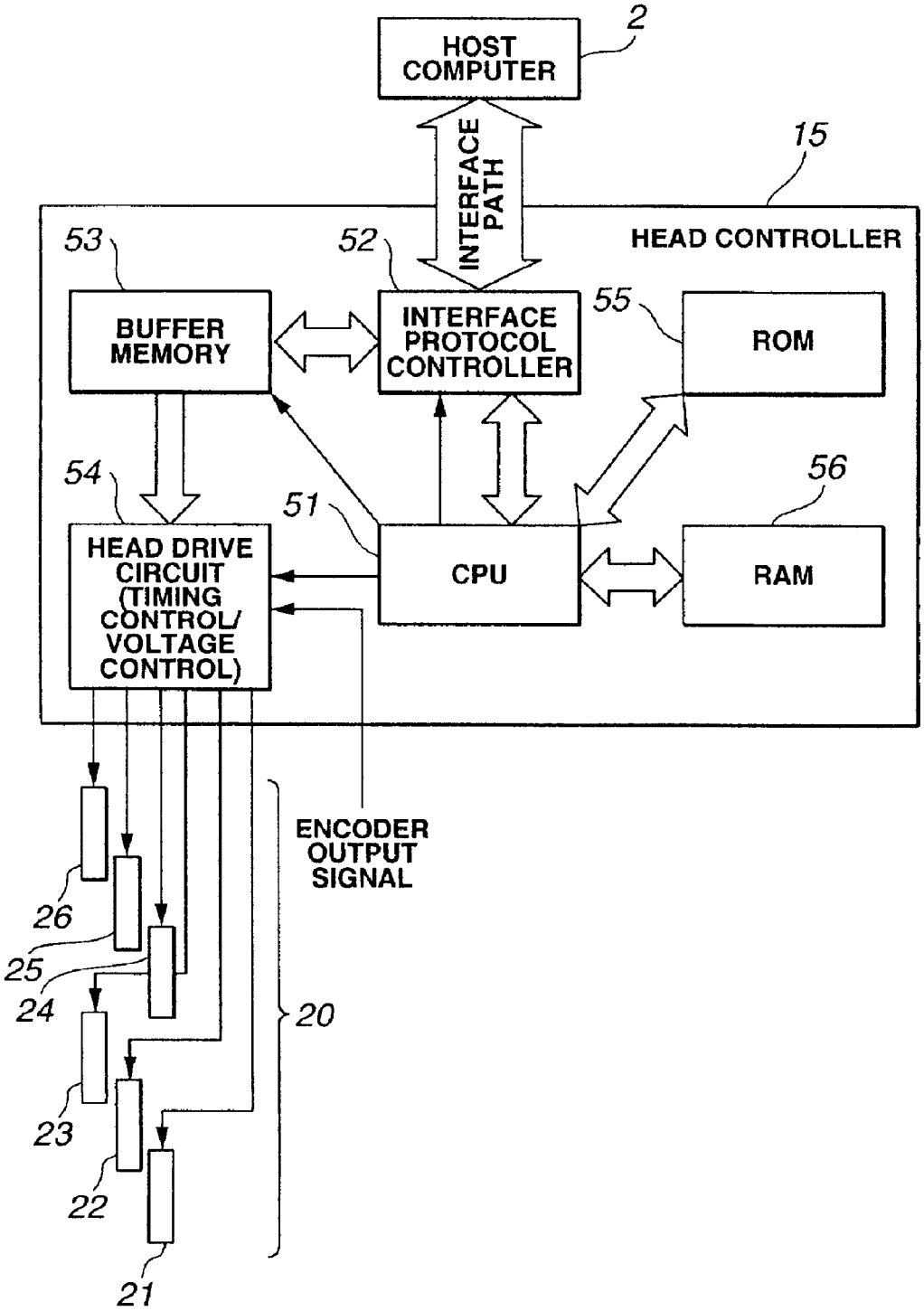
FIG. 2 is a block diagram of a head controller that is included in the printer system of the first embodiment shown in FIG. 1.
Figure 3A:
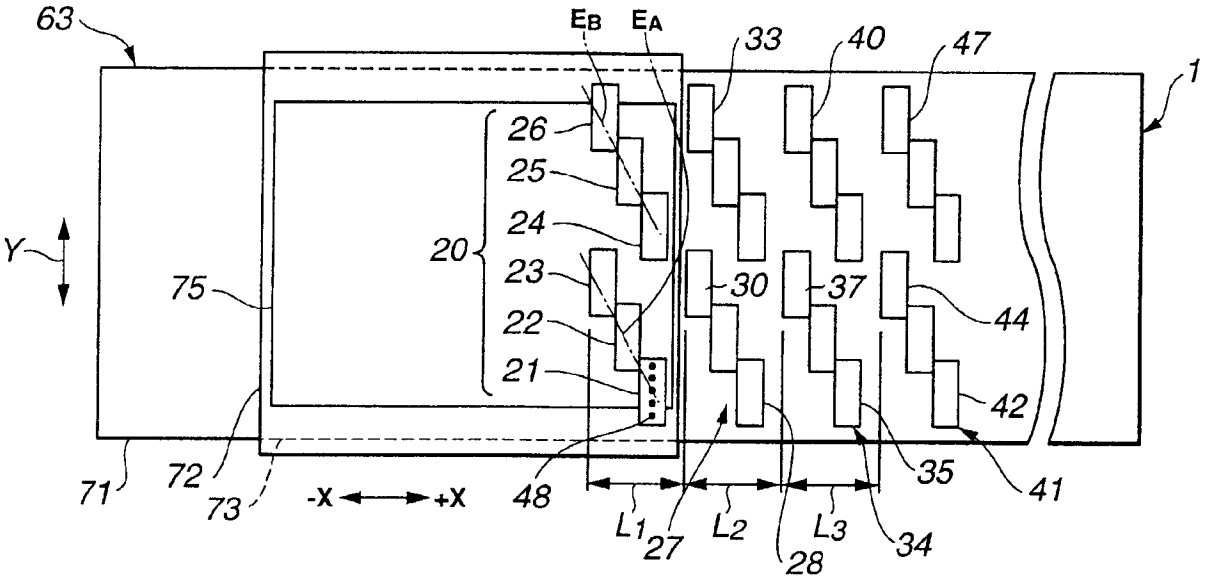
FIG. 3A is a plan view showing the arrangement of a printer section of the printer system of the first embodiment shown in FIG. 1.
Figure 3B:
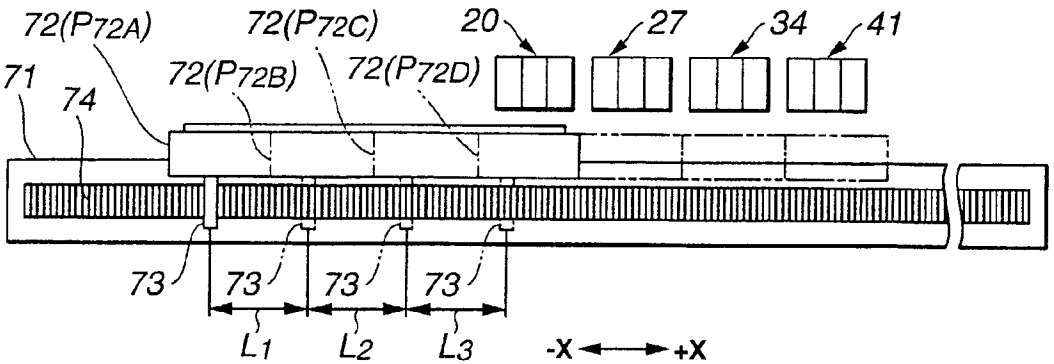
FIG. 3B is a side view showing the arrangement of the printer section of the printer system of the first embodiment shown in FIG. 1.

FIG. 1 is a block diagram showing a printer system of a first embodiment of the present invention. FIG. 2 is a block diagram showing a head controller of the printer system of this embodiment. FIG. 3A is a plan view showing the arrangement of a printer section of the printer system of this embodiment, and FIG. 3B is a side view along arrow A in FIG. 3A.

A printer system 1 of this embodiment is a type of inkjet printer that performs printing in one pass. Specifically, the printer system 1 includes a plurality of groups of print heads, each print head having a row of nozzles for discharging ink droplets, arranged over the entire width of the paper, and, during printing, feeds paper, which is a recording medium, in the feed direction without causing the print heads to scan in the horizontal direction (in the width direction and the feeding direction of the paper).

As shown in FIG. 1, the printer system 1 includes a host computer 2 that is responsible for the overall control of the printer system 1, and printer elements 11, 12, 13, and 14 for four colors, i.e., K (black), C (cyan), M (magenta), and Y (yellow). The printer system 1 further includes a paper feed controller 61, a paper feed mechanism 63, a head cleaning controller 62, and a head cleaning mechanism 64.

The printer elements 11, 12, 13, and 14 include K, C, M, and Y head controllers 15, 16, 17, and 18, respectively, which are connected in a SCSI (small computer system interface) interface daisy chain to the host computer 2 via a SCSI host adapter (1) 3. Meanwhile, the paper feed controller 61 and the head cleaning controller 62 are connected to the host computer 2 via corresponding RS-232C interfaces.

As shown in FIG. 1, the K printer element 11 includes the K head controller 15 for black and a K print head group 20. The C printer element 12 includes the C head controller 16 for cyan and a C print head group 27. The M printer element 13 includes the M head controller 17 for magenta and an M print head group 34. The Y printer element 14 includes the Y head controller 18 for yellow and a Y print head group 41.

As shown in FIG. 2, the K head controller 15 includes a CPU 51 for controlling the controller, an interface protocol controller circuit 52 connected to the host computer 2 via a SCSI interface bus, and a buffer memory 53 for storing black print data captured through the interface protocol controller circuit 52. The K head controller 15 further includes a head drive circuit 54 for driving the K print head group 20, and a ROM 55 and a RAM 56 which store data related to printing control. With this arrangement, the controller 15 does not have a complicated configuration since it controls only up to six heads for the same color.

In accordance with an encoder output signal from the paper feed mechanism 63 and black image-print data, the head drive circuit 54 controls the drive timing, pulse voltage, pulse width, and the like for each of the print heads constituting the K print head group 20, thereby controlling the timing and the amount of ink to be discharged.

The K print head group 20 is constituted by six heads, i.e., a K print head (0) 21, a K print head (1) 22, a K print head (2) 23, a K print head (3) 24, a K print head (4) 25, and a K print head (5) 26. Each K print head has an ink discharge surface, on which a row of nozzles 48 (FIG. 3A) is arranged along the Y direction for discharging ink.

The print heads 21 to 26 of the K print head group 20 are arranged in two rows of three heads along two oblique lines EA and EB at predetermined positions above the upper surface of a slide region of a paper feeding stage 72. In this arrangement, the rows of nozzles of the print heads are provided over the entire print width of the paper. For example, when the print head 23 is assumed to be a reference head of the print heads 21 to 26, the print heads 21, 22, 24, 25, 26 are arranged at predetermined distances relative to the reference print head 23 in the paper feeding direction. This means that image-print data for each print head contains blank data that depends upon the corresponding predetermined distance, i.e., data for instructing non-discharge of ink.

The C, M, and Y head controllers 16, 17, and 18 have the same configurations as the K head controller 15, and control the timing and the amount of ink to be discharged from the C print head group 27, the M print head group 34, and the Y print head group 41, respectively.

The C print head group 27 is also constituted by six C print heads (0) 28 to (5) 33 each having a row of nozzles. The M print head group 34 is constituted by six M print heads (0) 35 to (5) 40 each having a row of nozzles. The Y print head group 41 is also constituted by six Y print heads (0) 42 to (5) 47 each having a row of nozzles.

Similarly, with regard to the print heads (0) 28 to (5) 33 of the C print head group 27, the print heads (0) 35 to (5) 40 of the M print head group 34, and the print heads (0) 42 to (5) 47 of the Y print head group 41, the print heads of each print head group are arranged along two oblique lines in two rows along the Y direction, which is the width direction of the paper, at predetermined positions over a region in which the paper feeding stage 72 slides.

The K, C, M, and Y print head groups 20, 27, 34, and 41 are positioned in the X direction (the paper feeding direction) with an accuracy corresponding to the resolution such that the reference print heads 23, 30, 37, and 44 are arranged with predetermined distances L1, L2, and L3 therebetween. In addition, each print head of the K, C, M, and Y print head groups 20, 27, 34, and 41 are also positioned with reference to the print heads 23, 30, 37, and 44 with an accuracy at which the relative position in the X and Y directions of each print head corresponds to the resolution. When it is difficult to position each print head with an accuracy corresponding to a resolution, the discharge timing may be controlled by the CPU 51 and the head drive circuit 54 with a sub-pixel accuracy.

As shown in FIGS. 3A and 3B, the paper feed mechanism 63 has a base plate 71 and the paper feeding stage 72. The paper feeding stage 72 is provided on the base plate 71 and is driven to slide by a linear driving section in the feed direction (X direction). The sliding movement thereof is controlled by the paper feed controller 61.

A scale 74 for an encoder is provided on a side surface of the base plate 71 along the X direction. The pitch of the scale 74 is, for example, 0.070 mm, which corresponds to the resolution of the printer system.

The feeding stage 72 is driven by a feed driving section, not shown, in the X direction, and is equipped with one encoder (sensor) 73 at a position facing the scale 74 of the base plate 71. The encoder (sensor) 73 detects the amount of movement of the feeding stage 72 to determine the discharge timing of ink from the print heads. The encoder (sensor) 73 is formed of, for example, a photo-interrupter. The encoder 73 outputs encoded pulse signals, which are scale-pattern detection pulses output in response to movement relative to the scale 74, to the K, C, M, and Y head controllers 15 to 18. Each controller senses the amount of movement of the feeding stage 72 in accordance with the encoded pulse signal and internally generates the ink discharge timing.

The K, C, M, and Y head controllers 15, 16, 17, and 18 are assigned SCSI-ID (identification) numbers that are different from one another. In this embodiment, the K head controller 15 is assigned SCSI-ID #0, the C head controller 16 is assigned SCSI-ID #1, the M head controller 17 is assigned SCSI-ID #2, and the Y head controller 18 is assigned SCSI-ID #3. For this case, the LUN (logical unit number) is 0.

Each piece of data output from the host computer 2 is identified with an ID number and is then captured by the corresponding head controller. Instead of the SCSI interfaces, IEEE-1394 interfaces may be used. In such a case, the K, C, M, and Y head controller 15, 16, 17, and 18 are each assigned a different bus ID and a different node ID.

When printing an image, the printer system 1 configured as described above according to this embodiment first captures image data into the host computer. The host computer 2 then transfers image-print range data to the K, C, M, and Y head controllers 15, 16, 17, and 18 via the SCSI host adapter 3. The host computer 2 extracts pieces of image data for individual colors from the captured image data and also transfers the extracted pieces of image data to the corresponding K, C, M, and Y head controllers 15, 16, 17, and 18 via the SCSI host adapter 3. The pieces of image data for individual colors include K data, which is image data for the color K, C data, which is image data for the color C, M data, which is image data for the color M, and Y data, which is image data for the color Y. These pieces of image data are written into the corresponding buffer memory 53 and so on as image-print data. In this case, each piece of data transferred via the SCSI adapter (1) 3 is identified with a SCSI-ID and is forwarded to the corresponding K, C, M, or Y head controller 15, 16, 17, or 18.

Subsequently, the paper feed controller 61 start moving of the paper feeding stage 72 of the paper feed mechanism 63 from a predetermined start position, thereby starting the feeding of the paper 75. When a count of the number of pulses output from the encoder 73 becomes a value corresponding to a print start position P72A, the CPU 51 of the K head controller 15 instructs the head drive circuit 54 to start printing an image.

In accordance with the K-color image-print data stored in the buffer memory 53 and the pulse data output from the encoder 73, the head drive circuit 54 then begins to control ink discharged from each print head 21 to 26 of the K print head group 20. That is, the ink discharge timing is controlled while being synchronized with a pulse signal output from the encoder 73, and, simultaneously, in accordance with the K-color image-print data, the amount of ink discharged is controlled with a voltage for driving each print head.

Further, when the count of the number of pulses output from the encoder 73 reaches a value corresponding to an image-print start position P72B (a position at a distance of L1 from the print start position P72A in the +X direction) for the C print head group 27, the CPU of the C head controller 16 instructs the head drive circuit to print an image.

Likewise, when the number of pulses output from the encoder 73 reaches a count number corresponding to a position P72C located at a distance L1+L2 in the +X direction from the print start position P72A, or a position P72D located at a distance L1+L2+L3 in the +X direction from the print start position P72A, the corresponding M print head group 34 or Y print head group 41 starts printing an image.

When each of the print head groups 20, 27, 34, and 41 completes printing of a corresponding predetermined number of dots, each CPU issues a status message indicating the completion of the printing command. When the host computer 2 recognizes the message, the operation for image printing ends.

The operation for image-printing (printing) in the printer system 1 of this embodiment will now be described with reference to the flow charts in FIGS. 4 and 5.

Figure 4:
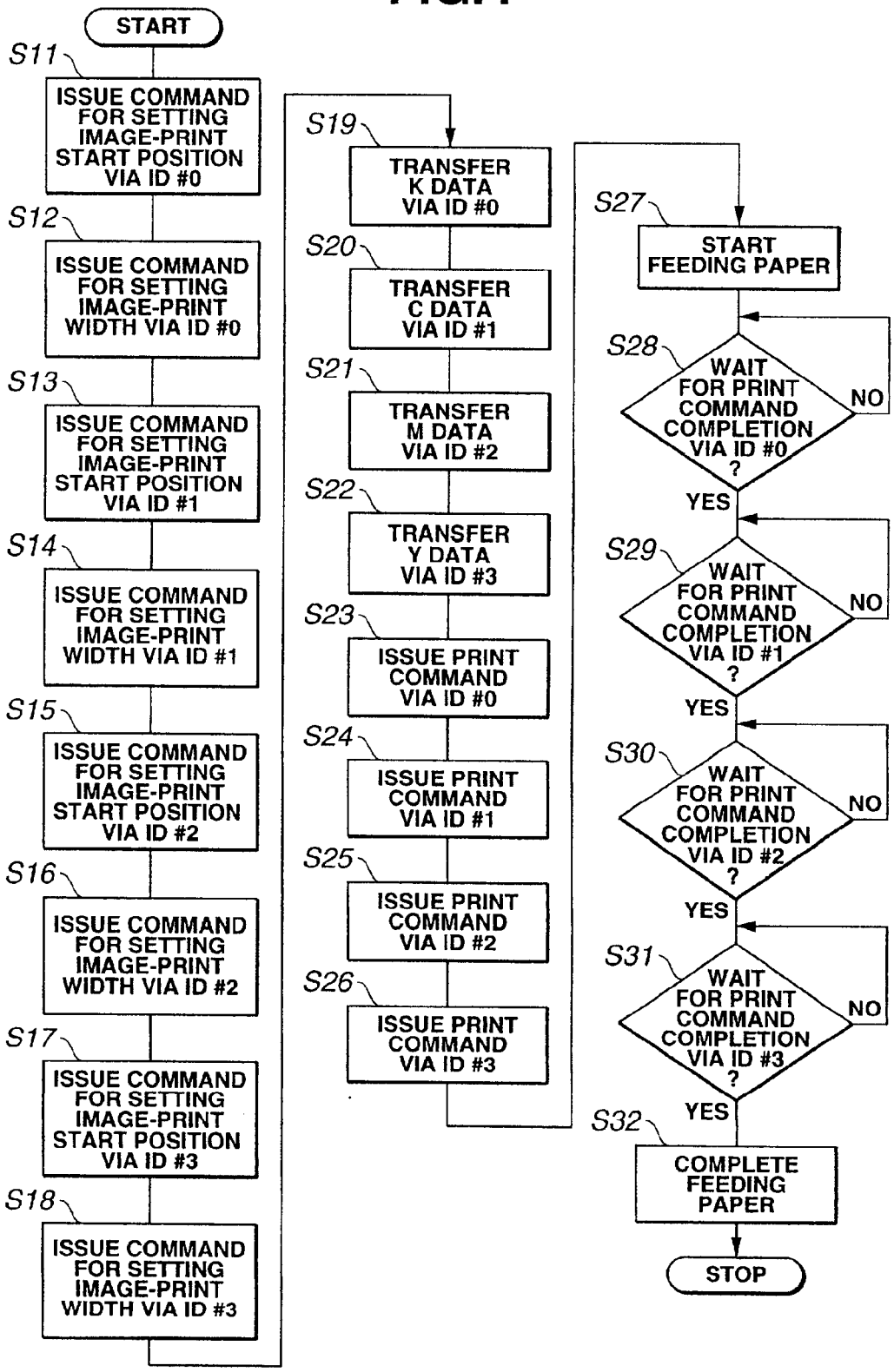
FIG. 4 is a flow chart showing image-printing processing in a host computer of the printer system of the first embodiment shown in FIG. 1.
Figure 5:
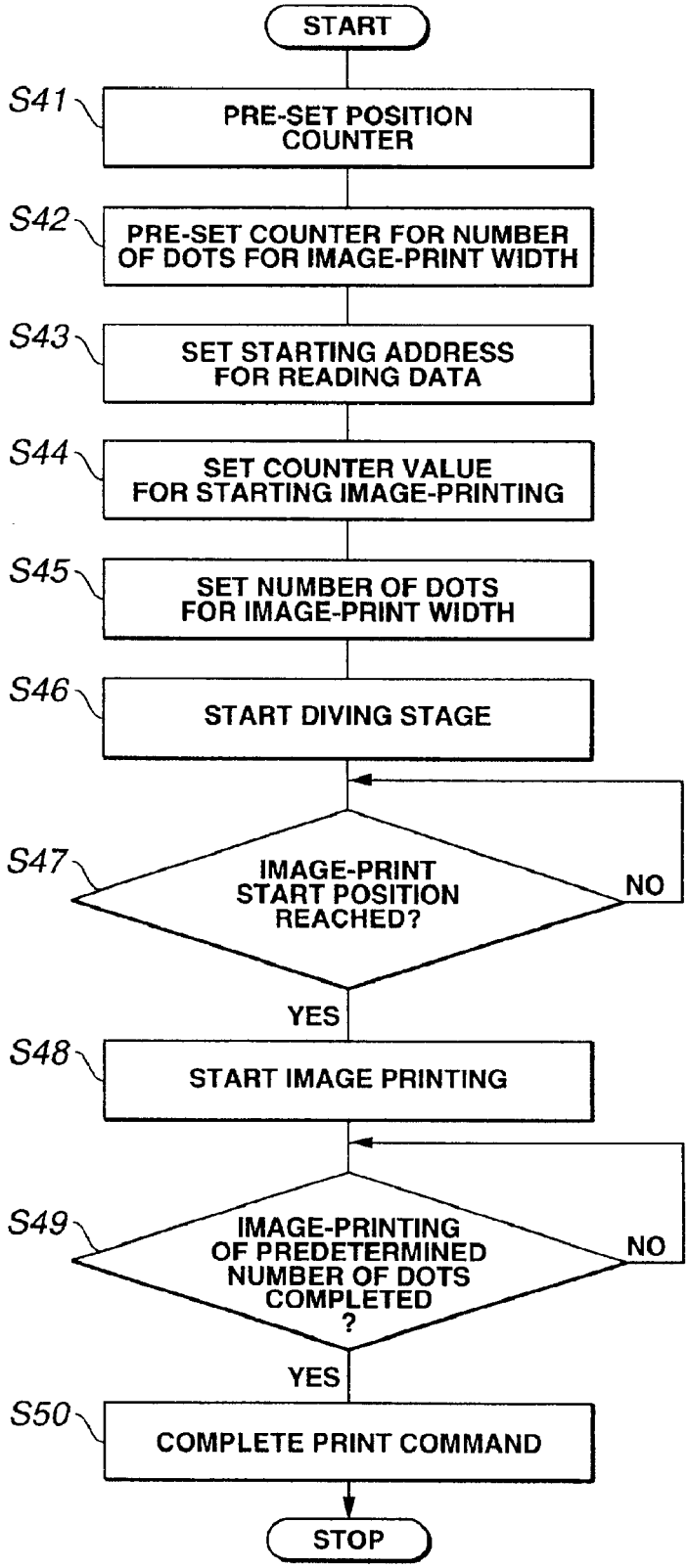
FIG. 5 is a flow chart showing image-printing processing in the head controller of the printer system of the first embodiment shown in FIG. 1.

FIG. 4 is a flow chart showing the processing in the host computer 2 for printing an image, and FIG. 5 is a flow chart showing the processing in each head controller, controlled by the host computer 2, for printing an image.

First, in the host computer 2, host-side image-control is initiated, as shown in the flow chart in FIG. 4. That is, in steps S11 and S12, a command for setting an image-print start position and a command for setting an image-print width are issued to the K head controller 15 via the SCSI-ID #0.

Next, in steps S13 and S14, a command for setting an image-print start position and a command for setting an image-print width are issued to the C head controller 16 via the SCSI-ID #1.

Further, in steps S15 and S16, a command for setting an image-print start position and a command for setting an image-print width are issued to the M head controller 17 via the SCSI-ID #2.

Further, in steps S17 and S18, a command for setting an image-print start position and a command for setting an image-print width are issued to the Y head controller 18 via the SCSI-ID #3.

In steps S19 to S22, K data, C data, M data, and Y data, which are image-print data for the corresponding individual colors, are forwarded to the K, C, M, and Y head controllers 15, 16, 17, and 18 via the SCSI-ID #0 to #3.

In steps S23 to S26, print commands are issued to the K, C, M, Y head controllers 15 16, 17, and 18 via the SCSI-ID #0 to #3.

Subsequently, in step S27, driving control for feeding paper is started to prepare the driving of the paper feed mechanism, thereby making the printer system ready for image printing.

In step S28, a printing completion command sent from the K head controller 15 via the SCSI-ID #0 is recognized, and in steps S29 to S31, similarly, the print completion commands sent from the C, M, and Y head controllers 16, 17, and 18 are recognized via the SCSI-ID #1, #2, and #3, respectively. The process then proceeds to step S32, in which the host computer 2 finishes driving of feeding the paper, and completes the image-printing control.

On the other hand, image-print control by the CPUs included in the K, C, M, and Y head controllers 15, 16, 17, and 18, which receive the commands from the host computer 2, are individually executed in accordance with the flow chart of FIG. 5.

Specifically, under the control of the CPU 51 and the like of each head controller, in step S41, a position counter indicating a feed position of paper is pre-set, and in step S42, a counter indicating the number of dots for image-print width is pre-set. Further, in step S43, a starting address for reading data from the buffer memory 53 is set.

In step S44, a value for an image-print start counter is set. The value is set in accordance with the image-print start-position data set in step S11.

In step S45, an image-print width is set. This image-print width is set in accordance with the value of image-print width setting forwarded in step S12, in which image-printing processing is performed at the host-side.

In step S46, the movement of the feeding stage 72 is initiated. In response to the movement of the feeding stage 72, an output from the encoder 73 is captured by the head drive circuit 54 and the like of each head controller 15, 16, 17, and 18.

In step S47, when it is determined that the feeding stage 72 has reached the image-print start position, the process proceeds to step S48 and image printing is initiated. It is to be noted that, in step S47, the image-print start-position of the feeding stage 72 is determined in accordance with the count of the number of pulse signals output from the encoder 73.

Also in this case, when it is determined, from the count value of the pulse signals output from the encoder 73, that the C, M, and Y print head groups 27, 34, and 41 reach count values corresponding to the distances L1, L2, and L3 from the image-print start position for the K printing head group 20, the C, M, and Y print head groups 27, 34, and 41 start image-printing.

In step S49, when it has been recognized that printing a predetermined number of dots is completed, the process proceeds to step S50, in which, image printing ends as completion of the print commands.

As the printer system of this embodiment, in an inkjet printer system that performs printing in one pass by feeding paper in the feed direction, ink discharging from the head group 20 to 41, each having a plurality of print heads, is controlled by the corresponding head controllers 15 to 18. In addition, for controlling the head controllers 15 to 18, the SCSI interfaces are connected in a daisy chain, and the head controllers 15 to 18 are identified with the SCSI IDs to transfer commands and image-print data, thereby controlling the printing. This can facilitate data transfer and the like from the single host computer 2 to each head controller, without complicated image-printing control.

When a need arises for increasing the number of colors to be printed in this printer system, for example, when a need exists for adding LC (light cyan) and LM (light magenta) to the K, C, M, and Y colors, the kinds of colors for image printing can be easily increased by assigning an unused SCSI-ID #4 to an LC head controller and assigning an unused SCSI ID #5 to an LM head controller.

When a need arises for increasing the image-print width, which is perpendicular to the paper feeding direction, for example, when a printer capable of printing A4-size paper with six heads per color is converted into a printer capable of printing A3-size paper, a SCSI host adapter (2) 4 is installed in the host computer 2 in addition to the existing SCSI host adapter (1) 3 and a SCSI ID that can be controlled by the additionally-installed host adapter is assigned to an additionally-installed head controller. A printer whose image-print width can be easily increased in this manner can be controlled by the single host computer 2.

In this embodiment, as shown in FIG. 3A, since heads are arranged along the lines EA and EB in slanting directions rather than in straight lines, it is also possible to arrange the rows of nozzles of the heads such that the rows partially overlap each other in the paper width direction. In this case, the present applicant has disclosed, in Japanese Unexamined Patent Application Publication No. 2000-1609, a technology that is applicable to such an arrangement, though, the publication is directed to a head-scan inkjet printer. In the publication, a plurality of rows of nozzles are arranged in the paper feeding direction such that the rows overlaps each other, and image-print data in overlapping portions are corrected.

In the first embodiment, although each K, C, M, and Y of the head controllers 15, 16, 17, and 18 is assigned the different ID number, as an alternative thereto, each of the K, C, M, and Y head controllers 15, 16, 17, and 18 can be assigned a different LUN number while being assigned the same SCSI ID number.

A printer system according to a second embodiment of the present invention will now be described.

Figure 6:
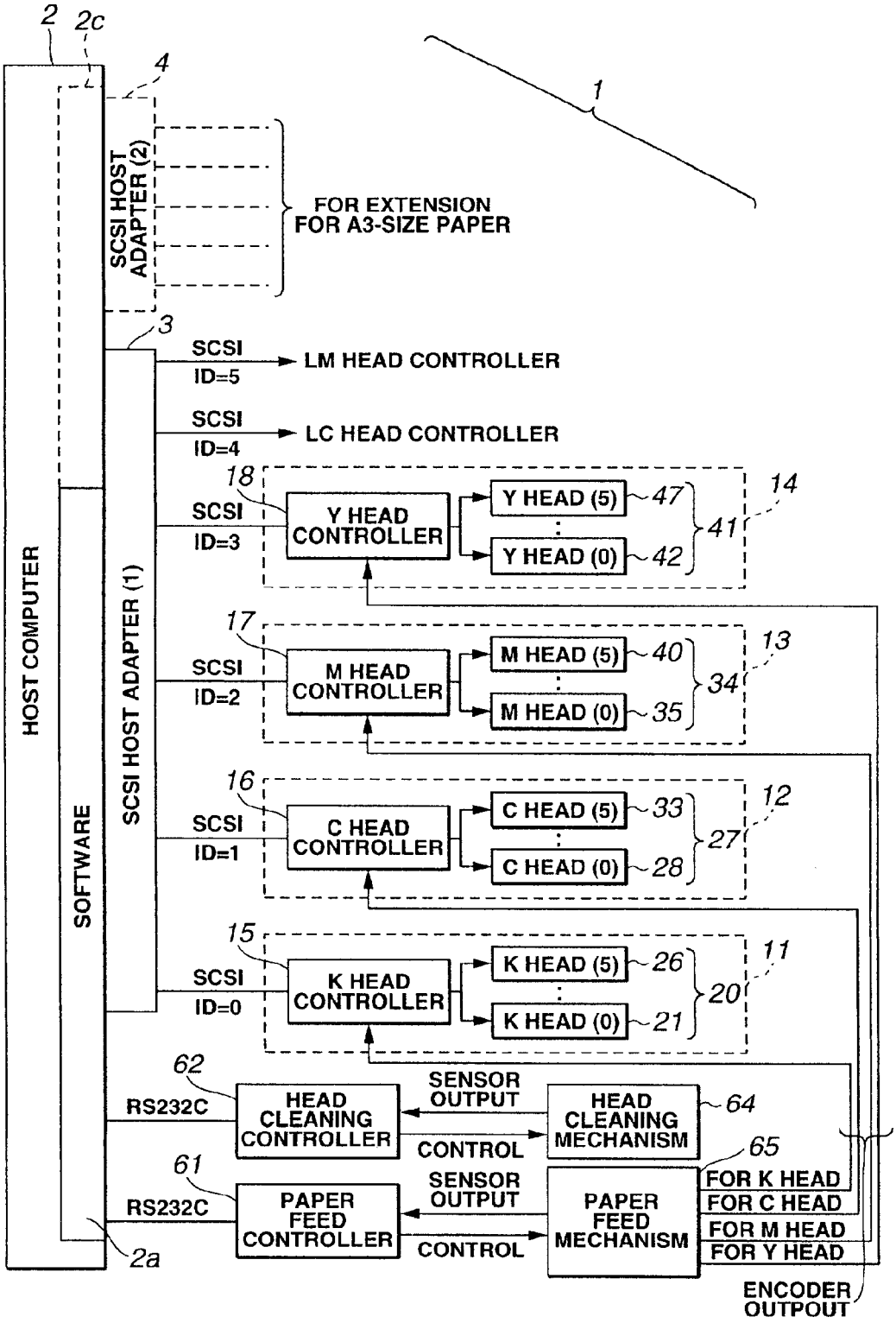
FIG. 6 is a block diagram of a printer system according to a second embodiment of the present invention.
Figure 7:
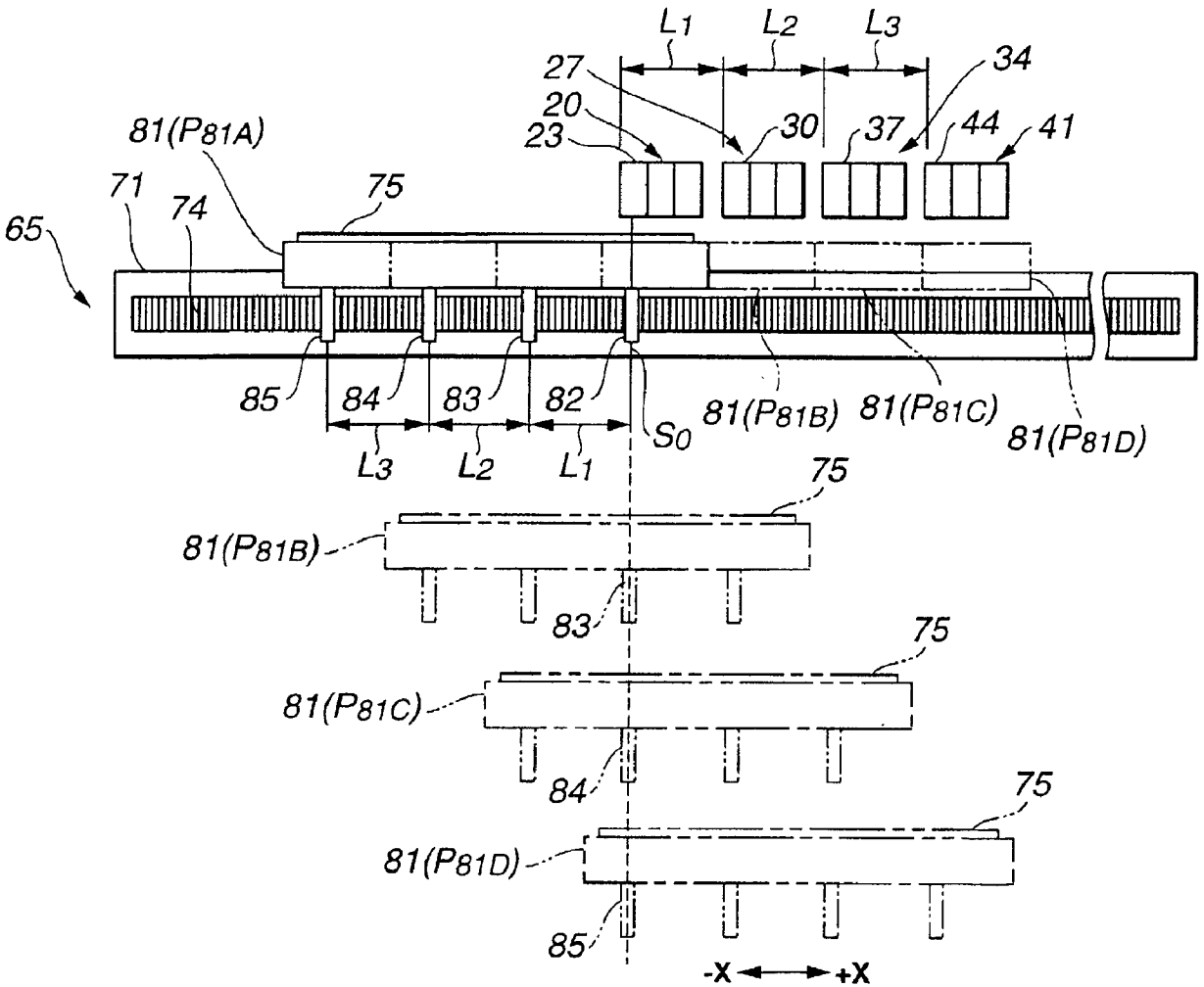
FIG. 7 is a side view, viewed from a direction perpendicular to the paper feeding direction, showing a printer section of the printer system of the second embodiment shown in FIG. 6.

FIG. 6 is a block diagram of a printer system of this embodiment. FIG. 7 is a side view, viewed from a direction perpendicular to the paper feeding direction, showing a printer section of the printer system of this embodiment, and also showing movement positions of a feeding stage.

As in the printer system 1 of the first embodiment, a printer system 70 of the second embodiment is a type of inkjet printer system that includes print head groups, each having a row of nozzles for discharging ink droplets, arranged over the entire width of paper and feeds the paper in the feed direction to perform printing in one pass, without causing the print heads to scan in a horizontal direction (the width direction and the feeding direction of the paper). The printer system 70 is different from the printer system 1 of the first embodiment in that encoders, provided at the feeding stage, for detecting a feed position are arranged so as to correspond to the print head groups. Portions different from those of the printer system of the first embodiment will now be described. In the following description, the same elements, other than the feeding stage, as those of the printer system 1 of the first embodiment are denoted with the same reference numerals.

The printer system 1 of the first embodiment, as described above, is configured as follows. The K, C, M, and Y print heads 20, 27, 34, and 41 are positioned in the X direction (the paper feeding direction) at the predetermined distance L1, L2, and L3 with an accuracy corresponding to the resolution. The feeding stage 72 is provided with only one encoder 73 for the above-described four print head groups. The pulse signals output from the encoder 73 are counted to determine whether the front end of the paper 75 reaches the lower portion of the reference print head of each print head group, thereby starting of printing by the print heads.

The scale 74, which is provided on a side surface of the base plate 71, inevitably has a pitch error (pitch irregularity). In a normal printing condition, for example, K-color printing dots and C-color printing dots are printed at the same positions, thereby representing a correct color.

When, however, the scale 74 has a pitch error, as described above, a printing pitch error occurs because a section of the scale 74 used for printing the color K and a section of the scale 74 used for printing the color C are different from each other. As shown in an enlarged view in FIG. 9, in which an arrangement of K-color printing dots and C-color printing dots during image printing are shown, there is a possibility that the C-color printing dots are printed at positions between the K-color printing dots. In this printing condition, it is impossible to represent a correct color.

Figure 9:
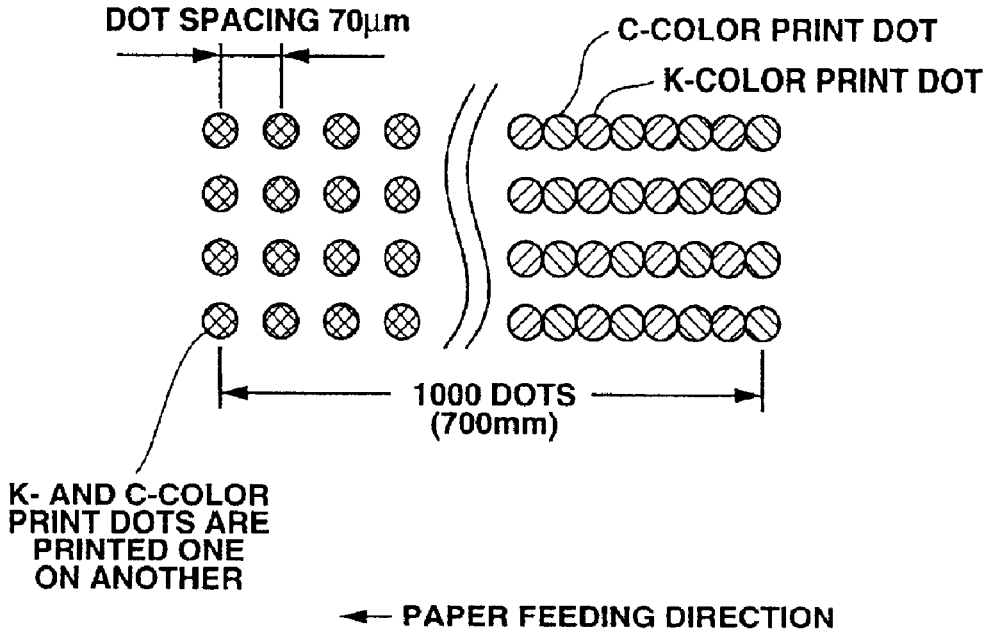
FIG. 9 is an enlarged view showing an arrangement of K-color print dots and C-color print dots when the printer system performs image printing.

In the case shown in FIG. 9, for example, the pitch of a scale region for use in printing the color K is 70 $\mu$m, and is different from the pitch of a scale region for use in printing the color C by 0.05% (i.e., 0.035 $\mu$m). The color K and the color C are assumed to be printed one on another in a region corresponding to 1,000 dots. In this case, at the beginning (the left side in FIG. 9) of image printing in the region, they are printed one on another in a substantially correct manner, but at the end (the right side in FIG. 9) of the image printing, the C color dot is displaced 35 $\mu$m from the correct position as a result of the multiplication of the pitch difference of 0.05% by 1,000 dots.

Accordingly, in the printer system 70 of this embodiment, as shown in FIG. 7, a feeding stage 81 is provided with four encoders (sensors) 82, 83, 84, and 85 corresponding to the four K, C, M, and Y print head group 20, 27, 34, and 41. The four encoders (sensors) each detect a movement position of the feeding stage 81 relative to each print head group to determine the discharge timing of ink from each print head. The scale 74 provided on a side surface of the base 71 is the same as the scale 74 in the first embodiment, and tolerates the pitch error.

As in the first embodiment, the reference print heads 23, 30, 37, and 44 of the K, C, M, and Y print head groups 20, 27, 34, and 41, respectively, are positioned in the paper feeding direction, i.e., in the X direction, with an accuracy corresponding to the resolution with predetermined distances L1, L2, and L3 therebetween. Naturally, the print heads other than the reference print heads of the K, C, M, and Y print head groups 20, 27, 34, and 41 are also adjusted at predetermined distances (in the paper feeding direction) relative to the reference print heads described above.

The encoders 82, 83, 84, and 85 are associated with the reference print heads 23, 30, 37, and 44 of the K, C, M, and Y print head groups 20, 27, 34, and 41, respectively, which are sequentially arranged in the +X direction, and are sequentially mounted on the feeding stage 81 in the opposite direction, i.e., in the −X direction. That is, the encoders 82, 83, 84, and 85 are positioned in the −X direction (in the direction opposite to the paper feeding direction) with an accuracy corresponding to the resolution so as to match the distances L1, L2, and L3 of the heads described above. (FIG. 7)

As shown in FIG. 6, the pulse signals output from the encoders 82, 83, 84, and 85 are individually captured by the K, C, M, and Y head controllers 15, 16, 17, and 18, respectively. Each head controller counts the pulse signals output from the corresponding encoder to determine whether the count reaches a count value corresponding to the image-print start position for each color.

In the printer system 70 of this embodiment, under the control of the host computer 2, the image-print range data, image-print data, image-print start command, and the like are transferred to each head controller 15, 16, 17, or 18 via the corresponding SCSI interface, thereby executing image printing, as in the printer system 1 of the first embodiment.

Detection of a feeding state of the paper 75 during image printing and operation of starting image printing will now be described with reference to FIG. 7, etc. First, under the control of the CPU 51 included in each head controller, the feeding stage 81 is started from a predetermined start position. When the encoder 82 reaches a reference position S0 (FIG. 7) for detecting the edge of paper on the base plate 71 (i.e. when the feeding stage 81 reaches a position P81A) and the count number of pulse signals output from the encoder 82 reaches a count number corresponding to an image-print start position for color K, the image-printing of the color K is started.

Next, when the encoder 83 reaches the reference position S0 (FIG. 7) for detecting the edge of the paper (i.e., when the feeding stage 81 reaches a position P81B) and the count of the number of the pulse signals output from the encoder 83 reaches a predetermined value, the C print head group 27 starts image-printing.

As in the case for the color K, the image printing by the C print head group 27 is controlled by the amount of movement from the common reference position S0.

Similarly, the M print head group 34 and the Y print head group 41 start image-printing when the corresponding encoders 84 and 85 reach the reference position S0, which is common to the case for the K print head group 20, (i.e., reach positions P81C and P81D of the feeding stage 81).

As described above, the feeding position of the paper 75 for all the print head groups is detected with reference to the common reference position S0 for detecting the edge of paper and all the print head groups perform image-printing in the same region on the scale 74. Thus, even if there is a pitch error in the scale 74 on the base plate 71, as described above, displacement, as shown in FIG. 9, of the print dots between the print head groups does not occur.

The printer system 70 of the embodiment described above offers the same advantage as the printer system of the first embodiment. Additionally, since the printer system 70 uses the plurality of encoders corresponding to the print head groups, it can perform high-quality printing without being affected by a pitch error of the scale 74 on the base plate 71.

In the printer system 70 of this embodiment, the encoders for detecting the movement position of the feeding stage are provided so as to correspond to the reference print heads of the print head groups. Alternatively, the encoders may be provided so as to correspond to the rows of the print heads that are arranged along the paper width, i.e., so as to correspond to the print heads arranged in the paper feeding direction of the print heads. This arrangement allows the control of ink discharge timing with still higher accuracy. Thus, this arrangement is the most advantageous in a printer system in which a plurality of long heads, each head being able to perform printing along the entire paper width, is arranged in the paper feeding direction.

While the printer system of each embodiment described above can perform printing in four colors, the substance of the present invention is not limited thereto and thus can be applied to a printer system with a single color or five or more colors.

Figure 8:
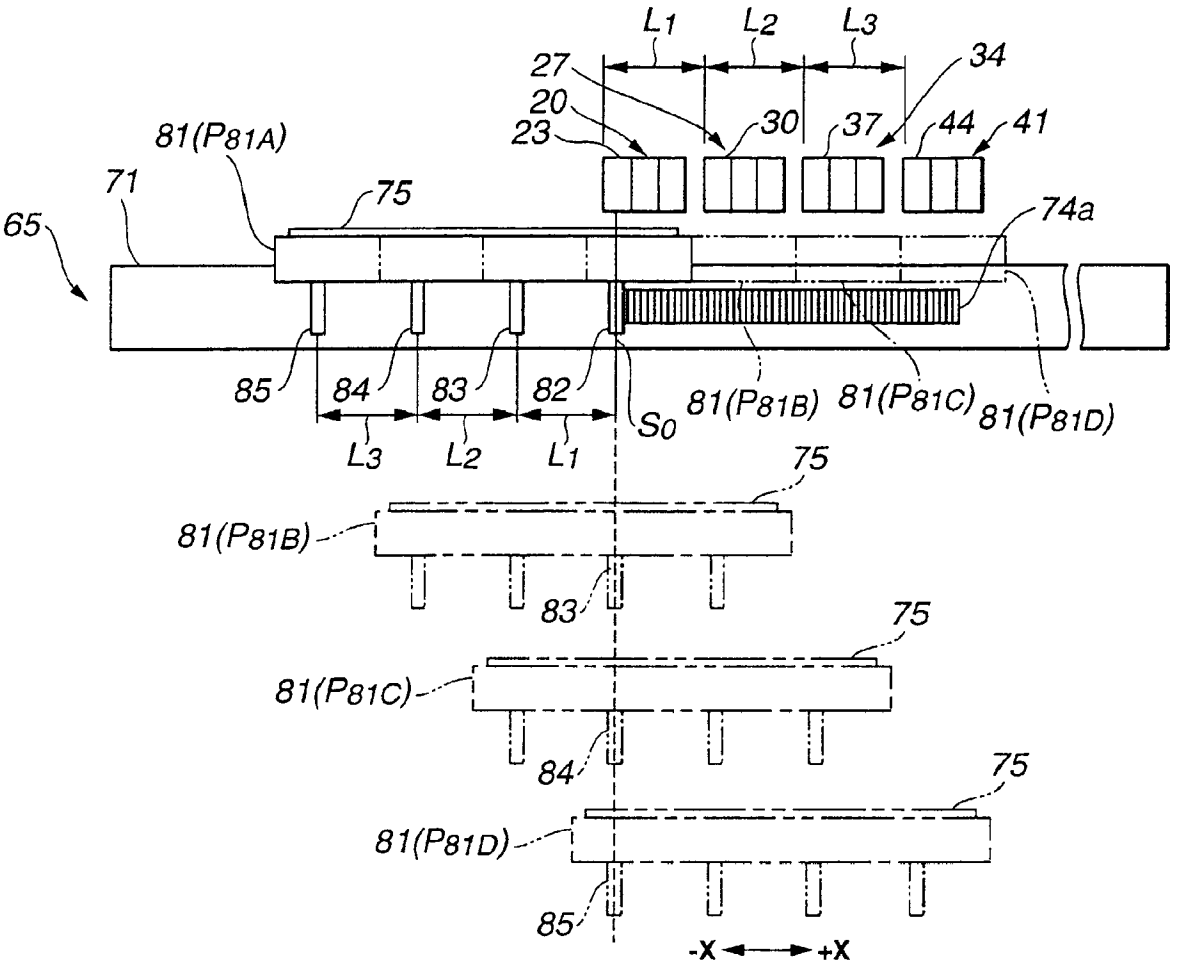
FIG. 8 is a side view, viewed from a direction perpendicular to the paper feeding direction, showing the printer section of the modification of the printer system of the second embodiment shown in FIG. 6.

While the scale 74 is provided over the movement region of the feeding stage 81 in the printer system 70 of the embodiment described above, for example, a scale 74*a* having a short length may alternatively be provided over a region from the reference position S0 to the right, i.e., +L1, +L2, and +L3, as shown in FIG. 8.

In this case, the feeding stage 81 is fed from the left to the right in the figure. When the encoder 82 reaches the reference position S0 (i.e., the position P81A), the encoder 82 detects output pulse signals for the first time. When the encoder 82 detects the output pulses, image printing of the color K is started.

Next, when the encoder 83 reaches the reference position S0 (i.e., the position P81B), similarly, the encoder 83 detects output pulse signals for the first time. When the encoder 83 detects the output pulses, image printing of the color C is started.

Likewise, when the encoders 84 and 85 each reach the reference position S0 (i.e., the positions P81C and P81D, respectively), the encoders 84 and 85 each detect output pulse signals for the first time. When the encoders 84 and 85 detect the output pulses, image printing of the colors M and Y are started, respectively.

In this manner, setting the scale 74*a* to be shorter than the movement region of the feeding stage 81 and setting the edge of the scale 74*a* at the reference position S0 at which image printing is started allows control of image-print start timing for each color. In addition, displacement of image printing position due to a scale pitch error becomes the same for each color, thus, displacement of dots does not occur.

While the printer systems 1 and 70 of the embodiments described above use the linear-driven feeding stage 72 and 81 as paper feed mechanisms, respectively, the substance of the present invention is not limited thereto and is also applicable to a printer system using a paper feed mechanism employing a belt driven mechanism. In such a case, a scale pattern is printed on the belt, and a single encoder or a plurality of encoders corresponding to the number of print head groups is used as an encoder for detecting a paper feeding position and is fixed to a main portion supporting the belt driving mechanism or is supported so that the position can be adjusted.

In addition, a rotating drum mechanism can be used as the paper feed mechanism. A modification, in which such a rotating drum mechanism is used, of the printer section for the printer system 70 of the second embodiment will now be described with reference to FIG. 10.

Figure 10:
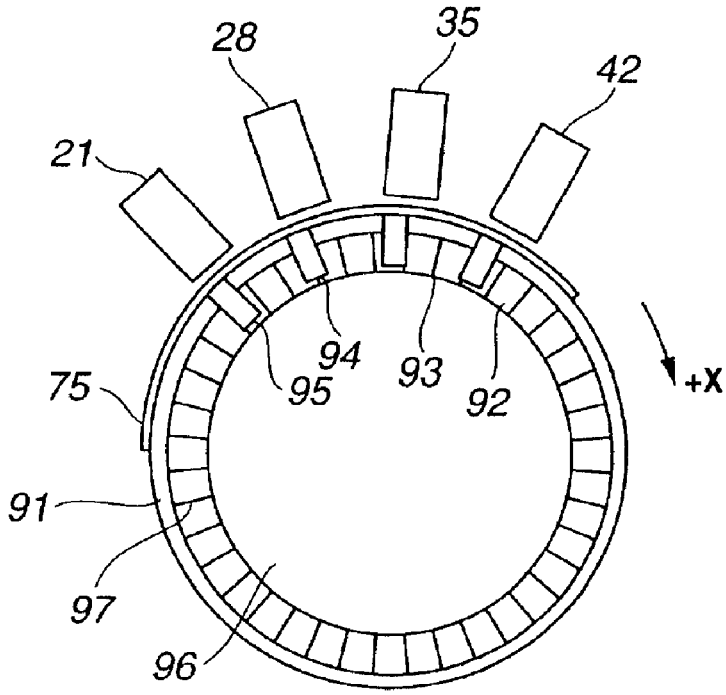
FIG. 10 is a side view, viewed from a direction perpendicular to the paper feeding direction, of the printer section of the modification of the printer system of the second embodiment shown in FIG. 6.

As shown in the side view in FIG. 10, the printer section in this modification is rotatably mounted on the cylindrical fulcrum 96, and has a rotating drum 91 that can suck and hold the paper 75. The K print head 21, the C print head 28, the M print head 35, and the Y print head 42 are fixed and supported in the outer circumference direction of the rotating drum 91. The cylindrical fulcrum 96 is provided with a scale 97 for circumferential encoders. Meanwhile, encoders (sensors) 92, 93, 94, and 95 are fixed to the rotating drum 91 at positions corresponding to the K print head 21, the C print head 28, the M print head 35, and the Y print head 42, respectively.

The encoders (sensors) 92, 93, 94, and 95 read the scale 97 of the cylindrical fulcrum 96 as in the case for the second embodiment, and count the encoder pulse signals to thereby determine whether or not the rotating drum 91 reaches a corresponding image-print start position for each print head. The encoders (sensors) 92, 93, 94, and 95 are positioned and fixed so as to have the same intervals as the K print head 21, the C print head 28, the M print head 35, and the Y print head 42, respectively.

In the printer section of the modification having the configuration described above, when starting image-printing, the rotating drum on which the paper 75 is held is rotated in the +X direction, and when the encoder 92 detects that the K print head 21 reaches the corresponding image-print start position, the K print head 21 starts image-printing in the color K. Likewise, when the encoders 93, 94, and 95 detect the image-print start position for the C print head 28, the M print head 35, and the Y print head 42, respectively, the print heads 28, 35, and 42 perform image printing in the corresponding colors.

When the printer section of this modification is used, such a printer system can perform the same control processing as the printer system 70 of the second embodiment and can provide the same advantage. In particular, the modification can reduce the space occupied by devices in the paper feeding direction and thus is advantageous in placing the printer device in a small place.

As described above, according to the printer system of the present invention, when the printer elements are connected to the host computer, they are connected via the common host interface. This can facilitate the connection of the printer elements, and can easily deal with a case in which the number of printer elements is increased or the print paper width is increased. In addition, this can facilitate the assignment of the printer elements by the host interface, and also can facilitate increasing the print width. Additionally, since the plurality of encoders is provided so as to correspond to the rows of the print heads or print head groups, the discharge timing of ink from the print heads can be controlled accurately, thereby allowing high-quality printing. In addition, since the plurality of encoders is provided so as to correspond to the rows of the print heads, the discharge timing of ink from different print heads can be controlled accurately, thereby allowing high-quality printing.

What is claimed is:

1. A non-scan printer system comprising a plurality of fixed printer elements which are arranged to print along a width direction of a recording medium without being scanned across the recording medium, each printer element including:

a one-color print-head group including a plurality of print heads for a single color;

a head controller or controlling the one-color print-head group; and a host interlace circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified with an identification number of the small computer system interface thereof; and wherein, when a number of colors to be used is increased, an additional printer element is provided which has an identification parameter different from the identification numbers of the small computer system interfaces of the plurality of existing printer elements.

2. A non-scan printer system comprising a plurality of fixed printer elements which are arranged to print along a width direction of a recording medium without being scanned across the recording medium, each printer element including:

a one-color print-head group including a plurality of print heads for a single color;

a head controller for controlling the one-color print-head group; and a host interface circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified with an identification number of the small computer system interface thereof; and wherein, when a printing width is increased in a direction perpendicular to a feeding direction of the recording medium, an additional printer element is provided which has an identification parameter different from the identification numbers of the small computer system interfaces of the plurality of existing printer elements.

3. A non-scan printer system comprising a plurality of fixed printer elements which are arranged to print along a width direction of a recording medium without being scanned across the recording medium, each printer element including:

a one-color print-head group including a plurality of print heads for a single color;

a head controller for controlling the one-color print-head group; and a host interface circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified with a logical unit number of the small computer system interface thereof; and wherein, when a number of colors to be used is increased, an additional printer element is provided which has an identification parameter different from the logical unit numbers of the small computer system interfaces of existing printer elements.

4. A non-scan printer system comprising a plurality of fixed printer elements which are arranged to print along a width direction of a recording medium without being scanned across the recording medium, each printer element including:

a one-color print-head group including a plurality of print heads for a single color;

a head controller for controlling the one-color print-head group; and a host interface circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified with a logical unit number of the small computer system interface thereof; and wherein, when a printing width is increased in a direction perpendicular to a feeding direction of the recording medium, an additional printer element is provided which has an identification parameter different from the logical unit numbers of small computer system interfaces of existing printer elements.

5. A non-scan printer system comprising a plurality of fixed printer elements which are arranged to print along a width direction of a recording medium without being scanned across the recording medium, each printer element including:

a one-color print-head group including a plurality of print heads for a single color;

a head controller for controlling the one-color print-head group; and a host interface circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified by a different combination of an identification number and a logical unit number of the small computer system interface thereof; and wherein when a number of colors is increased, an additional printer element is provided which has a different identification number and logical unit number combination than the small computer system interfaces of existing printer elements.

6. A non-scan printer system comprising a plurality of fixed printer elements which are arranged to print along a width direction of a recording medium without being scanned across the recording medium, each printer element including:

a one-color print-head group including a plurality of print heads for a single color;

a head controller for controlling the one-color print-head group; and a host interface circuit for controlling the one-color print-head group;

wherein the plurality of printer elements are controlled by a single host computer;

wherein the plurality of printer elements are respectively prepared in accordance with a plurality of colors to be used;

wherein a protocol of the host interface circuit in each printer element is a small computer system interface, and each of the printer elements is identified by a different combination of an identification number and a logical unit number of the small computer system interface thereof; and wherein when a printing width is increased in a direction perpendicular to a feeding direction of the recording medium, an additional printer element is provided which has a different identification number and logical unit number combination than the small computer system interfaces of existing printer elements.

* * * * *